US010123574B2

(12) United States Patent
Wilson

(10) Patent No.: US 10,123,574 B2
(45) Date of Patent: Nov. 13, 2018

(54) MULTI-SIZED WIRELESS PUSH-UP BRASSIERE

(71) Applicant: Peta Wilson, Pacific Palisades, CA (US)

(72) Inventor: Peta Wilson, Pacific Palisades, CA (US)

(73) Assignee: Peta Wilson, San Diego, CA (US)

( * ) Notice: Subject to any disclaimer, the term of this patent is extended or adjusted under 35 U.S.C. 154(b) by 273 days.

(21) Appl. No.: 15/146,891

(22) Filed: May 5, 2016

(65) Prior Publication Data

US 2016/0324221 A1 Nov. 10, 2016

Related U.S. Application Data

(60) Provisional application No. 62/156,505, filed on May 4, 2015.

(51) Int. Cl.
*A41C 3/00* (2006.01)
*A41C 3/10* (2006.01)

(52) U.S. Cl.
CPC ..... *A41C 3/0021* (2013.01); *A41C 3/10* (2013.01)

(58) Field of Classification Search
CPC ..... A41C 3/00; A41C 3/0021; A41C 3/142; A41C 3/0028; A41C 3/0064; A41C 3/04; A41C 5/00; A41C 5/005; A41C 1/003
USPC ..... 450/39, 86, 88, 54–61, 77, 31, 64, 65
See application file for complete search history.

(56) References Cited

U.S. PATENT DOCUMENTS 3,062,216 A * 11/1962 Stein ..... A41C 3/10 28/153
3,187,754 A * 6/1965 King ..... A41C 3/00 28/153
3,311,112 A * 3/1967 Murray ..... A41F 1/006 450/1
3,334,632 A * 8/1967 Rashkin ..... A41F 1/006 450/77
3,434,478 A * 3/1969 Cohen ..... A41C 5/005 139/425 R
4,143,662 A * 3/1979 Fisher ..... A41C 3/10 450/53
4,172,002 A * 10/1979 Gluckin ..... A41C 3/10 156/245
4,269,191 A * 5/1981 Evans ..... A41C 3/0028 450/64
4,372,321 A * 2/1983 Robinson ..... A41C 3/142 450/39
5,447,462 A * 9/1995 Smith ..... A41C 1/003 2/73
5,916,829 A * 6/1999 Girard ..... A41C 5/00 442/182
6,280,287 B1 * 8/2001 Keith ..... A41C 3/0028 450/1

(Continued)

*Primary Examiner* — Gloria Hale

(57) ABSTRACT

A wireless push-up brasserie having unique construction providing lift and support is disclosed. A cup portion has innovative materials, fabric cuts, seams and layers providing push-up and push-in to a wearer's bust line. Further to the enhanced look, the invention also provides substantial comfort and feel. Specialized elastic bands are additionally included to shoulder straps and a chest strap providing lift similar to spring force. The invention also adds versatility to its design to include size adjustment and optional criss-crossed back straps or adjusted to be worn as a halter around the wearer's neck.

29 Claims, 5 Drawing Sheets

(56) References Cited

U.S. PATENT DOCUMENTS

| | | | | |
|---|---|---|---|---|
| 6,918,812 | B2 * | 7/2005 | Giese | A41C 3/0021 450/65 |
| 7,131,888 | B2 * | 11/2006 | Hsu | A41C 3/0007 450/39 |
| 7,806,748 | B2 * | 10/2010 | Richardson | A41C 3/0021 450/61 |
| 8,187,053 | B2 * | 5/2012 | Haworth | A41C 3/0021 450/59 |
| 8,568,196 | B2 * | 10/2013 | Haworth | A41C 3/0021 450/60 |
| 8,758,081 | B2 * | 6/2014 | Yuasa | A41C 3/0028 450/31 |
| 8,758,082 | B1 * | 6/2014 | Woods | A41C 3/04 450/1 |
| 8,864,550 | B2 * | 10/2014 | Gleeson | A41C 3/0021 450/60 |
| 9,854,852 | B2 * | 1/2018 | Yuasa | A41C 3/12 |
| 2006/0052034 | A1 * | 3/2006 | Falla | A41C 3/0014 450/39 |
| 2006/0094333 | A1 * | 5/2006 | Wood | A41C 5/005 450/39 |
| 2007/0298680 | A1 * | 12/2007 | Martinet | A41C 3/12 450/39 |
| 2007/0298682 | A1 * | 12/2007 | Liu | A41C 3/0014 450/39 |
| 2008/0125011 | A1 * | 5/2008 | Gleeson | A41C 3/0021 450/59 |
| 2011/0086577 | A1 * | 4/2011 | Fleischman-Ament | A41C 3/0064 450/56 |
| 2015/0072592 | A1 * | 3/2015 | Van Dooren | A41C 3/0021 450/86 |

* cited by examiner

MULTI-SIZED WIRELESS PUSH-UP BRASSIERE

BACKGROUND OF THE INVENTION

Field of the Invention

The present invention pertains generally to wire-free support and push up type brassieres. More particularly, the invention relates to brassieres uniquely sewn and made with advanced fabrics and further providing adjustability to accommodate multiple sizes.

Description of the Prior Art

Bras worn as women's undergarments primarily for breast support have been known for millennia and improvements to the art are frequently provided. A relatively old example is provided by L. Amyot, entitled "BREAST MOULDING AND FOUNDATION GARMENT", U.S. Pat. No. 2,301,499, and was awarded patent protection in 1942.

According to Amyot, his invention relates to breast molding foundation garments and comprises a garment in which the breast pockets are designed to distribute the pull of the shoulder straps uniformly over the width of the pockets in such a manner that the breasts are given exceptionally high, well separated and rounded appearance and are adequately supported from beneath. Somewhat surprisingly, numerous related inventions have come forth purporting to achieve a similar universal objective, each purporting improved success than predecessor version. Specific examples are too numerous to fully summarize herein.

Also known in the art are underwire bras that provide substantial support and lift but however, are uncomfortable to the wearer. Additionally prevalent in the marketplace are bras that are sold by large retail stores that are generic in nature, or they address a singular function. A possible explanation for this is that certain customers are less discriminating in certain retail situations then perhaps they would like to be, for example, because of convenience and there being no other alternative on the market.

In light of the above, the present inventor herein has conducted over 500 consultations differently shaped and sized women to invent a brassiere having a custom adjustable design that would fit the variety of shapes and sizes encountered by the inventor in one adjustable solution, but however, having multiple embodiments as a matter of preference.

Therefore herein, it is an object of the present invention to provide a Multi-Sized Wireless Push-Up Brassiere that provides the wearer "push-up" and support without employing an underwire. It is an additional object of the present invention to offer a solution that is versatile adjustable, stylish, providing beauty and glamour. Still further, it is an object of the present invention to provide a bra that addresses a totality of needs of women in a complete singular package. Yet further, it is an object of the present invention to create a bra that has appropriate positioning of internal materials and seams also creating "push-up" and "push-in" forces, further enhancing a bust line. Additionally still, it is an object of the present invention to offer the wearer total back and shoulder adjustability.

BRIEF SUMMARY OF THE INVENTION

The present invention specifically addresses and alleviates the above mentioned deficiencies, more specifically, the present invention in a first aspect is a multi-sized wireless push-up brassiere that provides the wearer "push-up" and support without employing an underwire. The first aspect of the invention further provides the wearer a wider range of adjustability than what is typically found in the prior art. The presently preferred embodiment of the invention includes first and second cup portions configured about the bust line of the brassiere, a back strap, and first and second shoulder straps configured to the first and second cup portions, together providing support for the breasts of the wearer. The first and second cup portions each have a lower sling and an upper cup portion. It should be noted that the first cup, or left cup, is nearly identical to the second cup, or right cup. The only difference is that the elements of each are mirrored horizontally opposite to each other at the midpoint between the left and right cup. As such, in order to describe the invention fully, any reference to elements of the left cup should be understood as also describing elements of the right cup.

The lower sling and upper cup portion each have an internal knit mesh material having a web matrix construction, with the lower sling having a double layer of mesh and the upper cup portion having a single layer of mesh. In other embodiments, the lower sling may have one or more layers of mesh. The lower sling and upper cup portion are additionally surrounded by a combination skin of stretchable, breathable material on the outer portion and a stretchable comfortable material on the inside contacting the wearer's skin.

The layers of mesh are cut on their bottom edge at a bias or at an oblique angle to the parallel and perpendicular mesh web matrix. In other embodiments, only one layer of mesh in the lower sling has a bias cut. Cutting the mesh material in this manner yields extra elasticity properties for additional support of the wearer's breasts. Specifically, the bias cut on the lower sling mesh layers provides optimum elasticity creating an upward vertical or push-up force and an inward horizontal or push-in force, together providing superior support for the wearer's breasts.

The upper edge of the double layer of mesh of the lower sling, the lower edge of the single layer of mesh of the upper cup portion, and the skin of stretchable, breathable material on the outer portion are connected by a seam. The mesh layers of the lower sling and the combination skin of stretchable, breathable material on the outer portion and the stretchable comfortable material on the inside of the first and second cups, are sewn together at and along their bottom edges, along with the chest portion of the back strap. The mesh layers of the lower sling, the single mesh layer of the upper cup portion and the combination skin on the inner and outer portions are sewn together at and along their outer lateral edge along with the end portion of the respective shoulder strap. The single mesh layer of the upper cup portion and the combination skin of stretchable, breathable material on the outer portion and the stretchable comfortable material on the inside of the first and second cup portions are sewn together along their top edge. Additionally, a center piece in the shape of an isosceles trapezoid, made of an inner layer of non-stretch fabric and an outer layer of fabric matching the outer portion of the first and second cups, is sewn to the middle portions of the first and second cups together to secure them in place.

The center or chest strap portion of the back strap of the presently preferred embodiment, as mention previously, is sewn or otherwise attached to the bottom edge of the first and second cup portions. The two ends of the back strap are configured to pass around the torso of the wearer distributing breast load. The back strap has a sliding loop near each end constructed of the same materials as the back strap. The shoulder straps attach to these sliding loops, with the loops allowing the shoulder straps ends attached to the back strap to slide laterally inward or outward depending on the wearer's preference. The ends of the back strap each have complementary fastening components to connect the strap ends together about the horizontal midpoint of the wearer's back. Furthermore, the back strap has an adjustment component near each end allowing the wearer to adjust the length of the back strap by up to 8 inches or more, providing a range of adjustability that allows a precise fit for the wearer not seen in the prior art. This range of adjustability also allows for minimal required inventory sizes and stock numbers, saving any manufacturer of the invention money from the reduced production associated with the elimination of some of the sizes that would have been typically manufactured with products associated with prior art.

The back strap of the presently preferred embodiment is of a special construction, having a durable elastic strap material surrounded on the front and back by a layer of softer material for a comfortable feel on the wearer's skin when worn around the wearer's torso. The inner durable elastic strap material has a considerable snap back strength providing additional support and lift of the wearer's breasts. The adjustability and considerable snap back strength of the back strap allows the invention of the present invention to be worn along the bottom of the wearer's torso to accommodate a low back dress.

The shoulder straps of the presently preferred embodiment each have a first and second end with the first ends attached laterally along the outer edge of the respective first and second cups. The second end includes a hook or other mechanism which hooks to or otherwise attaches to the sliding loops near the ends of the back strap. This configuration provides the wearer with horizontal movement of the shoulder straps along the back strap to accommodate the wearer's specific preference or size. The shoulder straps also each have at least one adjustment component located between the first and second ends enabling the wearer to adjust the length of the shoulder straps for their specific size. Lastly, the shoulder straps can be arranged vertically across the wearer's shoulders, crisscrossed, or in other embodiments, adjusted as a halter around the wearer's neck as desired by the wearer.

In a second aspect, the invention is characterized as a multi-size wireless push-up brassiere similar to the characterization of the invention in the first aspect, except only the lower sling has an internal knit mesh material having a web matrix construction, rather than both the lower sling and upper cup portion. Additionally, the lower sling internal knit mesh material is folded over at the upper edge of the lower sling, with the fold in intact or cut, creating a double mesh layer. Other embodiments could include additional mesh layers. The double layer of mesh of the lower sling includes an upper edge which forms an unseamed transition from the lower sling to the upper cup portion; The mesh layers, like the previous embodiment, are bias cut on the bottom edges enabling the lower sling to provide the same optimum elasticity creating an upward vertical or push-up force and an inward horizontal or push-in force, together providing superior support for the wearer's breasts.

The lower sling and the upper cup portion of the first and second cup of the second aspect of the invention are also surrounded by a combination skin of stretchable, breathable material on the outer portion and a stretchable comfortable material on the inside contacting the wearer's skin. The primary difference between the first aspect of the invention and the second, presently preferred, aspect of the invention is that the upper edge of the lower sling is not attached to the upper cup portion or the inner or outer portions of the first and second cups.

The remaining elements of the second aspect of the invention including how the bottom, top, and lateral edges of the lower sling, inner and outer portion of the cups are joined, the construction and arrangement of the back strap and shoulder straps and the adjustability, convertibility and other benefits of the second aspect of the invention are identical to the elements described in the first aspect of the invention.

In a third aspect, which varies only slightly from the second aspect of the invention described above, the invention is characterized as a multi-sized wireless push-up brassiere having a first and second cup, a back strap, and a first and second shoulder strap. The third aspect is characterized as having all of the same elements of the second aspect of the invention described above, except the outer portion of breathable material covering the outside of the first and second cup portions is made from alternating lycra, velvet, or cotton material, or other similar materials known in the art, in a zig-zag pattern.

While the apparatus and method has or will be described for the sake of grammatical fluidity with functional explanations, it is to be expressly understood that the claims, unless expressly formulated under 35 USC § 112, or similar applicable law, are not to be construed as necessarily limited in any way by the construction of "means" or "steps" limitations, but are to be accorded the full scope of the meaning and equivalents of the definition provided by the claims under the judicial doctrine of equivalents, and in the case where the claims are expressly formulated under 35 USC § 112 are to be accorded full statutory equivalents under 35 USC § 112, or similar applicable law. The invention can be better visualized by turning now to the following drawings wherein like elements are referenced by like numerals.

BRIEF DESCRIPTION OF THE DRAWINGS

The novel features of this invention, as well as the invention itself both as to its structure and its operation, will be best understood from the accompanying drawings, taken in conjunction with the accompanying description, in which similar reference characters refer to similar parts, and in which.

DESCRIPTION OF PREFERRED EMBODIMENTS

Figure 1A:
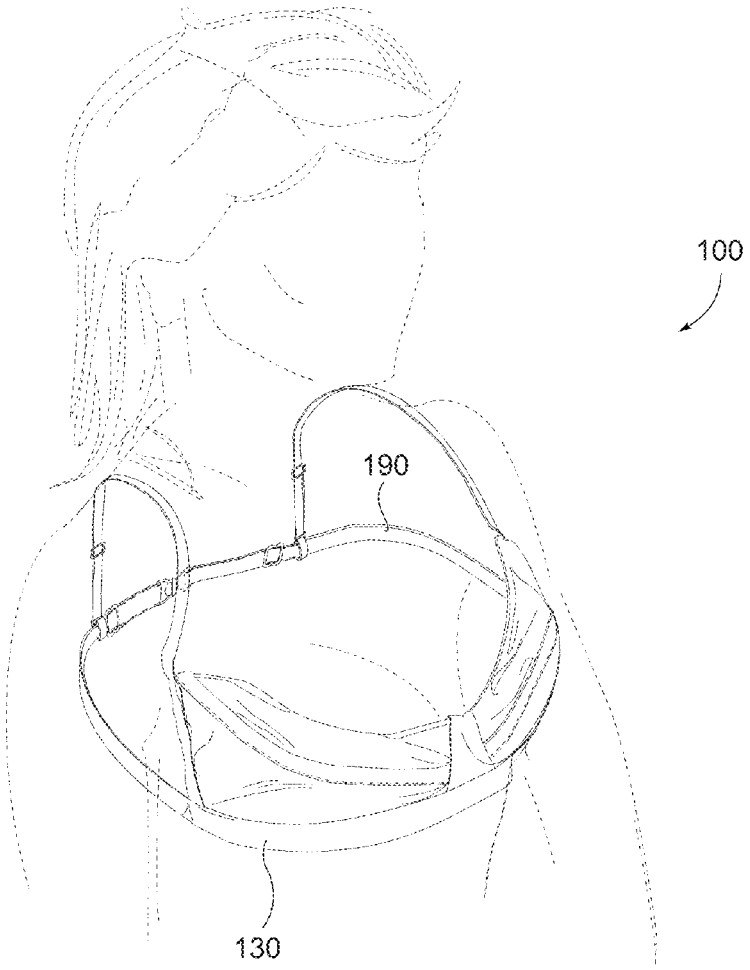
FIG. 1A shows a first preferred embodiment of the present invention being worn.

Initially with regard to FIG. 1A, a first preferred invention embodiment 100 is shown being worn. Back strap 190 is shown having first and second ends extending from a center area of back strap 190, chest strap 130, around a wearer's torso and connecting at the midpoint of wearer's back. Back strap 190 is constructed of a durable elastic strap type material. This material may be a woven polyester elastic type or a woven cotton elastic type having extra material in the weave (due to interlacing at right angles making longitudinal and lateral threads). Hence, the strap material employed will not narrow significantly when stretched and provide considerable snap back strength (similar to spring force). The woven elastic material is then surrounded by a softer stretchable velvet trim or other similar material known in the art, on both sides. The three layers may be further appropriately sewn together. Alternatively, the softer stretchable velvet trim material may be an elongated tube that encapsulates and compresses around the strap material while still maintaining the shape of back strap 190. Back strap 190 and its accompanying snap back strength will provide a wearer of the present invention extra support of the breasts without the use of an underwire.

Figure 1B:
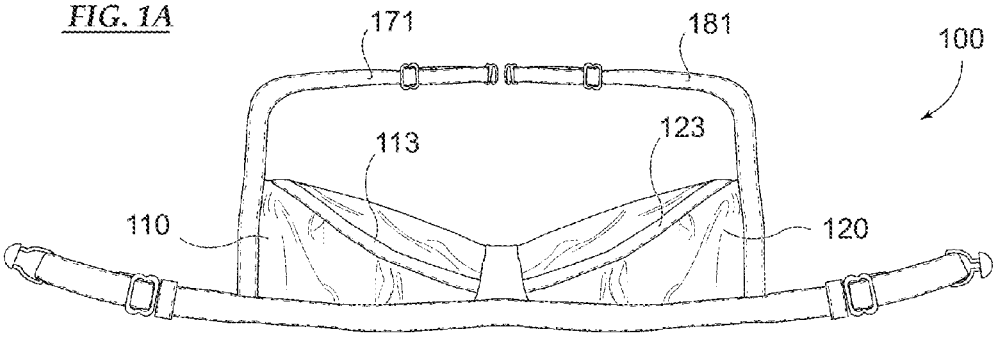
FIG. 1B is a front plan view thereof.

With reference to FIG. 1B, the first preferred invention embodiment 100 is shown from a front perspective. Right cup 110 and left cup 120 are shown with respective seams 113 and 123 each separating a lower sling and upper cup portion of respective cups 110 and 120. Additionally, FIG. 1B shows a first end of shoulder straps 171 and 181 sewn or otherwise attached perpendicularly to chest strap 130. The outer edges of the respective right and left cups 110 and 120 are sewn or otherwise attached along the inner edge of shoulder straps 171 and 181.

Figure 1C:
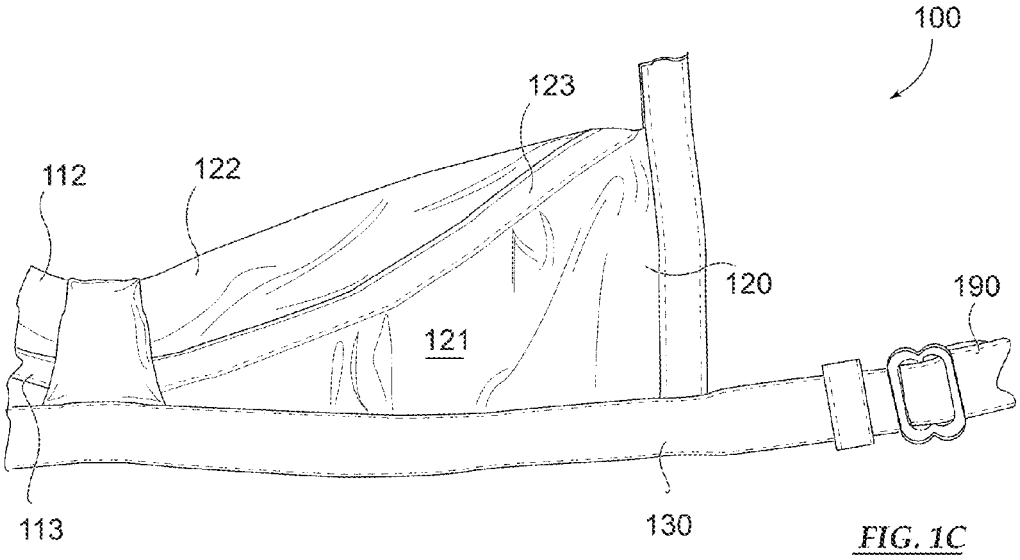
FIG. 1C is a close up view of the left cup of the brassiere in FIGS. 1A and 1B.

With reference to FIG. 1C, a close up view of left cup 120 of the first preferred embodiment 100 of FIG. 1A is shown. Left cup 120, is nearly identical to right cup 110 from FIGS. 1A and 1B, with the only difference being the elements of one are mirrored horizontally opposite to each other at the midpoint of chest strap 130. In order to describe the invention fully, any reference to elements of left cup 120 should be understood as also describing elements of right cup 110. Left cup 120 is separated by seams 123 into upper cup portion 122 and lower sling 121. Chest strap 130 runs along the bottom of left cup 120 with the upper edge of chest strap 130 sewn, or otherwise attached by means known in the art, to the lower edge of lower sling 121. Chest strap 130 is the portion of back strap 190 that is attached to left cup 120

Herein, the lower sling 121 contains internal, double-layered mesh surrounded by a combination skin of stretchable, breathable soft LYCRA spandex material, or similar material known in the art, on the outer portion and stretchable comfortable velvet, LYCRA spandex, or cotton material, or other similar material known in the art, on the inside that would contact a wearer's skin. In other embodiments the number of layers of mesh in the lower sling could vary. The upper cup portion 122 has a similar construction, except the mesh is but a single layer within the combination skin, rather than multiple layers.

Figure 1D:
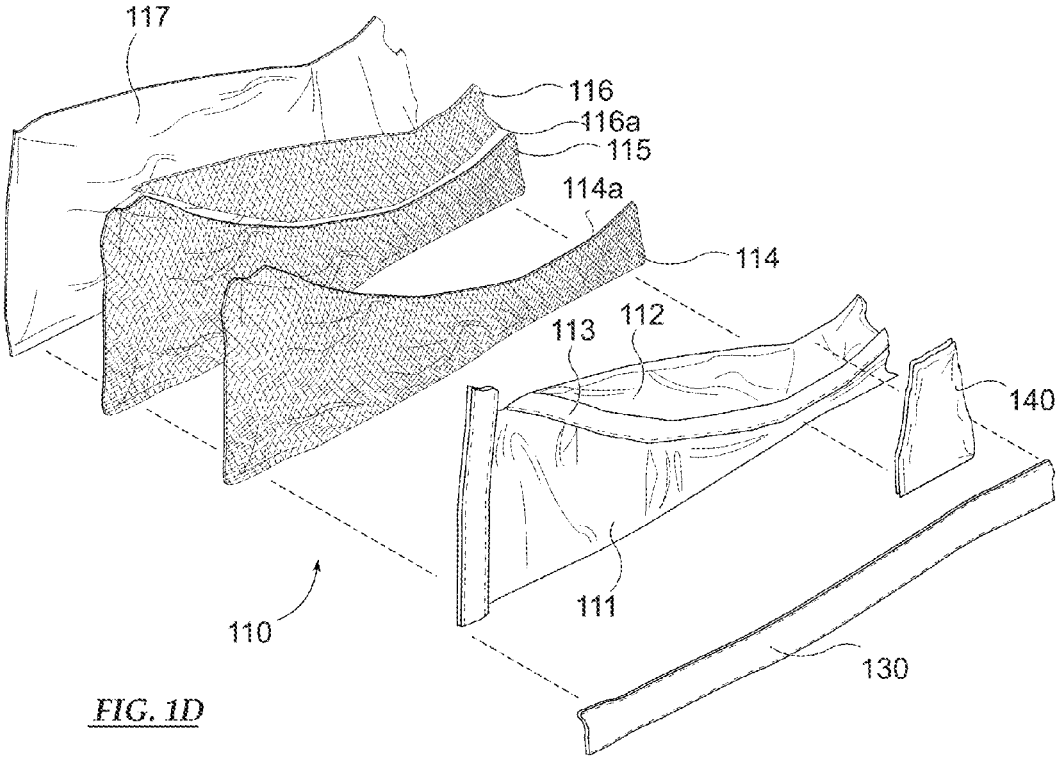
FIG. 1D is an exploded view of the right cup of the brassiere in FIGS. 1A and 1B, illustrating a multi layered aspect of the present invention.

FIG. 1D shows an exploded view of right cup 110, illustrating the multilayered aspect of the first preferred embodiment 100. Here, similar to the preceding description of FIG. 1C, any reference to elements of right cup 110 could be understood as also describing elements of left cup 120. Right cup 110 includes lower sling 111 and upper cup portion 112 which are connected and differentiated by seam 113. Lower sling 111 includes mesh layers 114 and 115 and is differentiated from the upper cup portion at an edge 114A. Upper cup portion 112 includes mesh layer 116 and is differentiated from the lower sling by an edge 116A. Edge 116A is immediately adjacent to edge 114A, but in other embodiments they could overlap or be spaced slightly apart.

Mesh layers 114, 115, and 116 are of a tightly knit mesh material having a web matrix construction. In the cutting, sewing and exact stitching of mesh layers 114, 115 and 116, a bias cut is further employed yielding elastic properties for support. The bias cut is more specifically described in this embodiment by mesh layers 114, 115, and 116 having bottom edges that are cut at an oblique angle to the parallel and perpendicular mesh material web matrix. The technique provides greater stretch in the bias or diagonal direction of the fabric causing it to accentuate body lines and curves. Furthermore, the bias cut provides optimum elasticity to create push-up and push in characteristics which create additional support for the wearer's breast.

FIG. 1D further shows backing 117, made of a stretchable, soft and comfortable material positioned on the inside of cup 110 closest to and in contact with the wearer's skin when the present embodiment is worn. As 117 makes contact with the wearer's skin, it should be made from a fabric that does not irritate, chafe, or otherwise bother the wearer's skin, such as LYCRA spandex or a similar material known in the art. The outer portion of cup 110, furthest from the wearer's skin, is made of stretchable, breathable cotton jersey material or a similar material known in the art.

The outer portion of right cup 110, mesh layers 114, 115, and 116 are sewn or otherwise joined at edges 114A and 116A by seam 113. The upper edge of the front of upper cup portion 112 is sewn or otherwise joined to backing 117 at its upper edge. The bottom edge of lower sling 111 is sewn or otherwise attached to mesh layers 114 and 115 and backing 117 by seams located along the edges of center cup panel 140 and along chest strap 130.

Figure 1E:
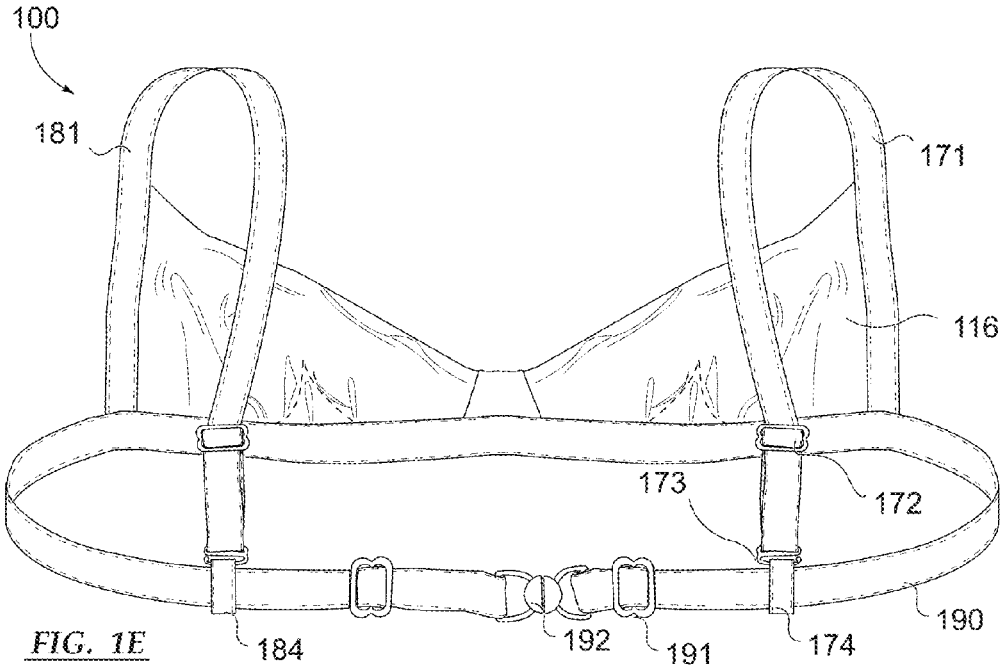
FIG. 1E is a rear plan view of the brassiere in FIGS. 1A and 1B, illustrating adjustment of the shoulder and back straps.

FIG. 1E is a rear plan view of the first preferred embodiment 100 of FIGS. 1A and 1B illustrating adjustment of the shoulder and back straps. Here, similar to the preceding descriptions, any reference to elements of the right side of the brassiere in the current embodiment could be understood as also describing elements of the left side of the brassiere. Right shoulder strap 171 has a first end attached to the chest strap and a second end going through strap adjuster 172 through the loop on strap hook 173 and back through strap adjuster 172 where the second end is secured creating a loop of shoulder strap 171 between strap adjuster 172 and strap hook 173. When strap adjuster 172 is slid along the length of shoulder strap 171 toward back strap 190, the effective length of shoulder strap 171 from its first end, at chest strap 130, to strap hook 173 is lengthened. Sliding strap adjuster 172 in the opposite direction along shoulder strap 171 toward chest strap 130 shortens the effective length of 171 between chest strap 130 and shoulder strap hook 173. Strap hook 173 is removably hooked to sliding loop 174, with sliding loop 174 made of the same durable elastic material as the back strap surrounded by a soft stretchable velvet trim material. Sliding loop 174 can be moved along the back strap 190, either toward or away from the horizontal midpoint of the wearer's back providing additional adjustability and also convertibility of the shoulder straps. The adjustability of shoulder strap 171 provided by the employment of sliding loop 174 and strap adjuster 173 allows for the wearer to achieve a desired fit regardless of the wearer's body size or shape.

Back strap 190, like shoulder straps 171 and 181 is also adjustable. The left end of back strap 190 goes through strap adjuster 191, through the left side of fastener 192 and back through strap adjuster 191 where it is secured, creating a loop of back strap 190 between strap adjuster 191 and fastener 192. Moving strap adjuster 191 along back strap 190 away from fastener 192 increases the length of the loop and shortens the effective length of the left side of back strap 190 between the right cup and fastener 192. Moving strap adjuster 191 in the opposite direction lengthens the effective length of back strap 190. The adjustability of both sides of back strap 190 provides a range of up to inches or more of adjustable length allowing the wearer to achieve a desired fit regardless of their body size or shape. This adjustability further allows for minimal required inventory and additional complicating stock numbers (SKUs) by eliminating multiple product sizes having only minimal adjustability. The adjustability also allows the back strap to be worn at the lower portion of the wearer's torso to hide the strap when wearing a low back dress.

Figure 1F:
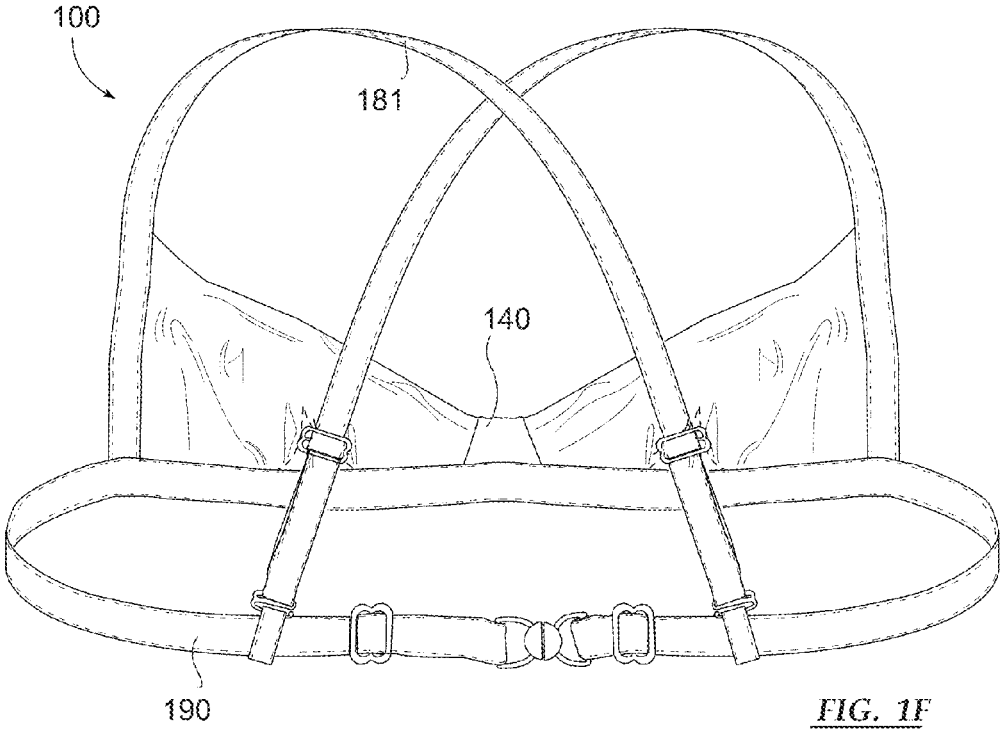
FIG. 1F is a rear plan view of the brassiere in FIGS. 1A and 1B, illustrating the shoulder straps in a crisscrossed position.

FIG. 1F is a rear plan view of the brassiere in FIGS. 1A & 1B, illustrating the shoulder straps in a crisscrossed position. Left shoulder strap 181 has its strap hook removed from its respective sliding loop and connected to the sliding loop of the right shoulder strap resulting in shoulder strap 181 crossing from the left to the right side of the wearer's back. The right shoulder strap is arranged in the same manner with its strap hook connected to the sliding loop of the left shoulder strap resulting in the right shoulder strap crossing from the right to left side of the wearer's back. The ability to attach each shoulder strap to either the left or right sliding loops and the adjustability of the length of the shoulder straps allows for the shoulder straps to be worn either straight up and down, crisscrossed, or adjusted to be worn as a halter around the wearer's neck as desired by the wearer, for instance, to hide the shoulder straps while wearing different style shirts, dresses or blouses.

Figure 2A:
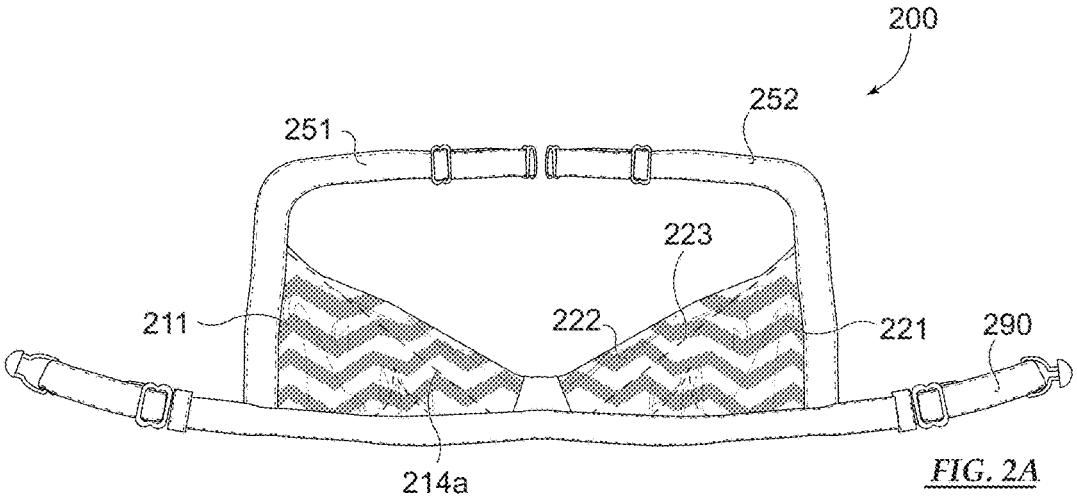
FIG. 2A is front plan view of a second preferred embodiment of the present invention.

FIG. 2A is front plan view of a second preferred embodiment 200 of the present invention. A similar dual upper and lower cup construction is provided. However, in this embodiment, there isn't a typical seam 113 as in the first embodiment at the transition from lower sling to upper cup portion. Instead, line 223 illustrates where the edge of the inner mesh material separates a lower sling 221 from an upper cup portion 222. As before, the inner mesh provides elastic properties necessary for lift and support. Also in this particular version, outer skin has a special configuration having a stretchable LYCRA spandex, velvet, or cotton material, or other similar material known in the art, at the outer portion thereof, further in a zig-zag pattern. The inner skin is comprised of soft breathable cotton material, or similar material as known in the art. Just as the first preferred embodiment, this embodiment has identical left and right elements which are mirrored about the horizontal centerline of the center cup panel. For example, this embodiment has a right shoulder strap 251, a left shoulder strap 252, a right cup lower sling 211 with edge 214*a*, a left cup lower sling 221, shoulder strap 190 and similar shoulder and back strap fastening and adjustability elements.

Figure 2B:
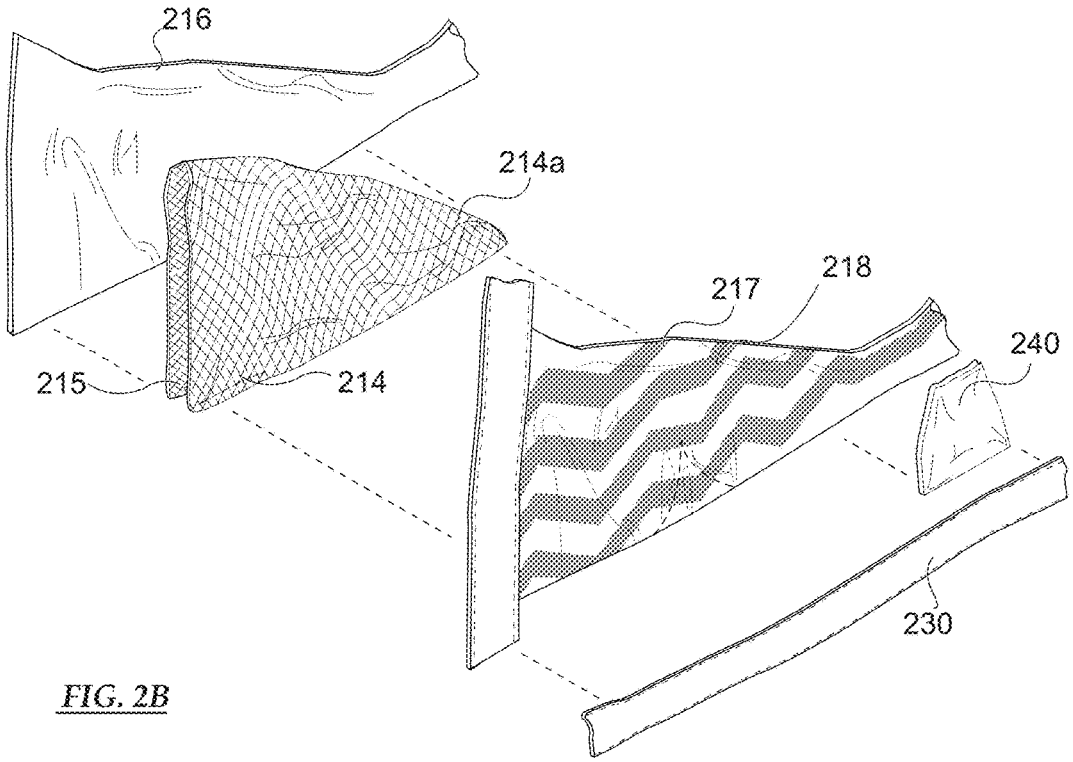
FIG. 2B is an exploded view of right cup of the brassiere of FIG. 2A, illustrating a multi-layered aspect of the brassiere of FIG. 2A.

FIG. 2B is an exploded view of the right cup of the brassiere of FIG. 2A, illustrating a multi-layered aspect of the brassiere of FIG. 2A. Here, similar to the preceding description of FIG. 2A, any reference to elements of the right cup could also be understood as describing elements of the left cup. The right cup of present embodiment includes an outer skin portion having a special configuration having LYCRA spandex 218 and soft velvet 217, or similar materials known in the art, at the outer portion thereof, further in a zig-zag pattern.

The right cup further includes a mesh layer folded over at edge 214*a*, creating mesh layers 214 and 215, which are of the same tightly knit mesh material having a web matrix construction as in the first preferred embodiment. In other embodiments the fold could be cut to create layers 214 and 215 and additional layer(s) of mesh could be included as well. Edge 214*a* delineates the lower sling and the upper cup portion of the present embodiment. In the cutting, sewing and exact stitching of mesh layers 214 and 215, a bias cut is further employed yielding elastic properties for support. The bias cut is more specifically described in this embodiment by mesh layers 214 and 215 having bottom edges that are cut at an oblique angle to the parallel and perpendicular mesh material web matrix. The technique provides greater stretch in the bias or diagonal direction of the fabric causing it to accentuate body lines and curves. Furthermore, the bias cut provides optimum elasticity to create push-up and push in characteristics which create additional support for the wearer's breast.

FIG. 2B further shows backing 216, made of a stretchable, soft and comfortable material positioned on the inside of the right cup closest to and in contact with the wearer's skin when the present embodiment is worn. As 216 makes contact with the wearer's skin, it should be made from a fabric that does not irritate, chafe, or otherwise bother the wearer's skin, such as stretchable lycra, cotton, or a similar material known in the art. Backing 216 provides full coverage and has a softer elasticity for comfort, but is, however not needed for support as the mesh layers 214 and 215 provide the support for the breasts.

The outer portion of the right cup, mesh layers 214 and 215 and backing 216 are sewn together on the bottom edge of the lower sling at seams located along the edges of the center cup panel 240 and along chest strap 230 The outer portion of the right cup and backing 116 are sewn together, or otherwise attached by methods known in the art, at a seam located at the upper edges of backing 216 and the outer portion. Unlike the first preferred embodiment the edge of the lower sling, edge 214*a*, is not attached to the upper cup portion, but rather is free and unrestricted between backing 216 and the outer portion of the right cup.

Figure 3A:
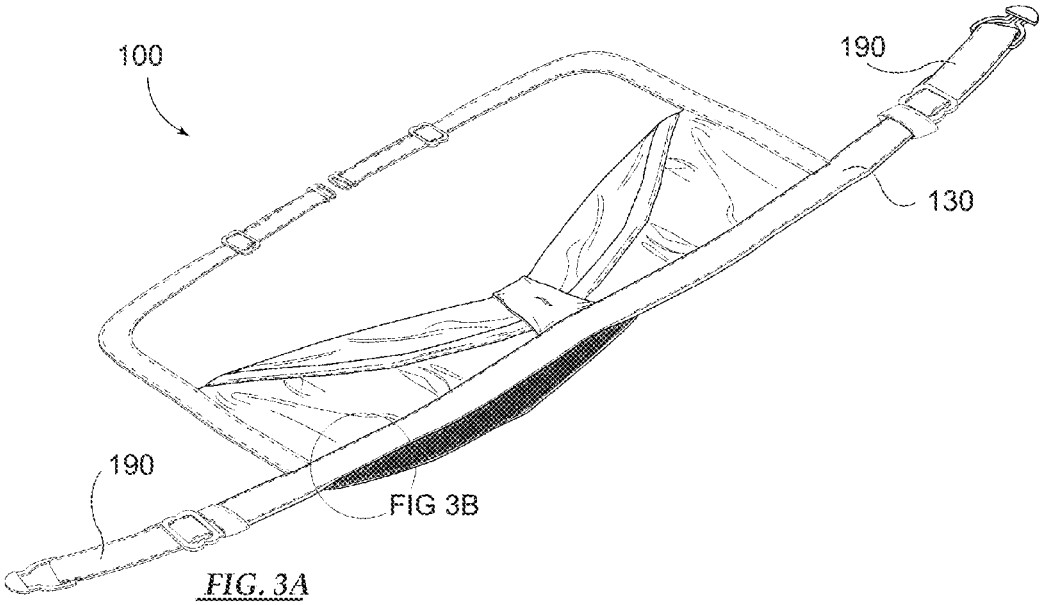
FIG. 3A is a front plan view of the first preferred embodiment of FIGS. 1A and 1B, illustrating the multi-layered aspect of the chest and back strap of the brassiere of FIGS. 1A and 1B.

FIG. 3A is a front plan view of the first preferred embodiment 100 of FIGS. 1A and 1B, illustrating the multi-layered aspect of the chest and back strap of the brassiere of FIGS. 1A and 1B. Chest strap 130, which is the center area of back strap 190 running laterally along the bottom edges of the right and left cup, is shown with a portion of its lower seam nearest the bottom right corner of the right cup open for the purpose of showing the multi-layered aspect of chest strap 130 and back strap 190. This particular area is enlarged in FIG. 3B for clarity purposes.

Figure 3B:
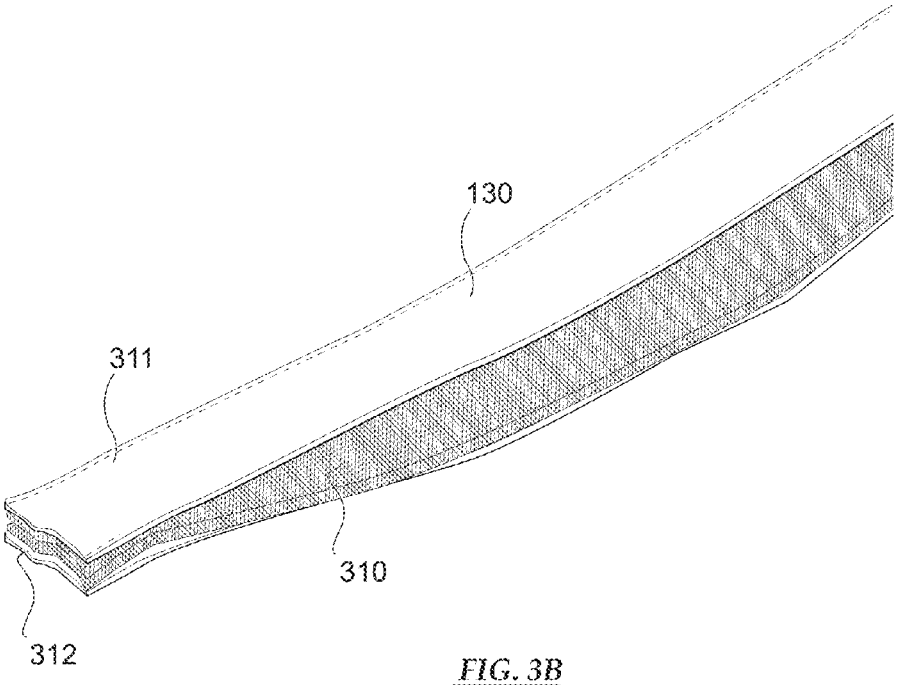
FIG. 3B is close up view of the multi-layered aspect of the chest and back strap of the brassiere of FIGS. 1A and 1B.

FIG. 3B is close up view of the multi-layered aspect of the chest and back strap of the brassiere of FIGS. 1A and 1B. A unique strap construction is provided wherein elastic strap 310 has durable elastic properties provide lift of the wearer's breast when the present embodiment is worn. Specifically, elastic strap 310 may be woven polyester elastic or woven cotton elastic, or a similar material known in the art, having extra material in the weave (due to interlacing at right angles making longitudinal and lateral threads). Hence, the elastic strap 310 will not narrow significantly when stretched and will provide considerable snap back strength (similar to spring force). The elastic strap 310 is surrounded by outer fabric 311 and inner fabric 312 on both sides, both of which are of a stretchable softer velvet trim material, or similar material known in the art. In this embodiment outer fabric 311, elastic strap 310, and inner fabric 312 are further appropriately sewn together. In other embodiments, the outer softer stretchable velvet trim material may be an elongated tube that encapsulates and compresses around the strap material while still maintaining the shape of chest strap 130. In such alternative, there may or may not be a need to sew the outer stretchable velvet trim material to elastic strap 310.

All embodiments herein are created with optimum directional sewing and curvature of seams that are ideal for support.

It should be understood, of course, that the foregoing relates to exemplary embodiments of the invention and that modifications may be made without departing from the spirit and scope of the invention as set forth in the following claims.

Many alterations and modifications may be made by those having ordinary skill in the art without departing from the spirit and scope of the invention. Therefore, it must be understood that the illustrated embodiments have been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

While the particular Multi-Size Wireless Push Up Brasserie as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

What is claimed:

1. A multi-sized wireless push-up brassiere for providing adjustable breast support and lift for a wearer's breasts, comprising:

a first cup portion;

a second cup portion, the first and second cup portions configured for wear about a bust line of the brassiere wearer;

a back strap;

said back strap including adjustment components configured to adjust a circumferential size of the brassiere about a torso of said wearer;

a first shoulder strap configured for attachment to the first cup portion; and a second shoulder strap configured for attachment to the second cup portion;

wherein the first and second cup portions are attachment to the back strap, and the first and second shoulder straps are configured for adjustably supporting the breasts of the wearer; and wherein the first and second cup portions each further comprise a lower sling and an upper cup portion, wherein the lower sling includes at least one layer of an internal mesh material to provide breathable support to said wearer's breasts.

2. The multi-sized wireless push-up brassiere of claim 1, wherein the lower sling and upper cup portion comprises a combination skin of stretchable, breathable material on an outer portion thereof and a stretchable comfortable material on an inside portion contacting the wearer's skin; and wherein the lower sling internal mesh material comprises one or more layers.

3. The multi-sized wireless push-up brassiere of claim 2, wherein the upper cup portion further comprises an internal single layer of mesh material between the combination of skin of stretchable, breathable material on the outer portion and stretchable comfortable material on the inside portion contacting the wearer's skin;

wherein the one or more layers of mesh of the lower sling comprises an upper edge and the single layer of mesh of the upper cup portion comprises a lower edge;

wherein the lower and upper edges are connected by a seam forming a seamed transition between the lower sling and the upper cup portion;

wherein the layer of mesh from the upper cup portion and the one or more layers of mesh from the lower sling each comprise a tightly knit mesh material having a web matrix construction of parallel and perpendicular oriented yarns;

wherein further the layer of mesh and the one or more layers of mesh each comprise a bias cut, the bias cut comprising a bottom edge cut at an oblique angle to the parallel and perpendicular mesh web matrix;

wherein further the bias cut yields extra elasticity properties providing additional support of the wearer's breasts; and wherein the one or more layers of mesh of the lower sling provides optimum elasticity creating an upward vertical push-up force and an inward horizontal push-in force, together providing support for the wearer's breasts.

4. The multi-sized wireless push-up brassiere of claim 2, wherein the one or more layers of mesh of the lower sling comprise an upper edge, the upper edge forming an unseamed transition from the lower sling to the upper cup portion;

wherein the one or more layers of mesh from the lower sling comprises a tightly knit mesh material having a web matrix construction of parallel and perpendicular oriented yarns;

wherein the one or more layers of mesh comprises a bias cut, the bias cut comprising a bottom edge cut at an oblique angle to the parallel and perpendicular mesh web matrix;

wherein further the bias cut yields extra elasticity properties providing additional support of the wearer's breasts; and wherein the one or more layers of mesh of the lower sling provides optimum elasticity creating an upward vertical push-up force and an inward horizontal push-in force, together providing support for the wearer's breasts.

5. The multi-sized wireless push-up brassiere of claim 1, the first and second cup portions further comprising a bottom edge;

wherein the back strap comprises:

a first end;

a second end;

a center area chest strap; and adjustment components;

wherein the chest strap is attached to and connects to the bottom edge of the first and second cup portions;

wherein the first and second ends are configured to pass around the torso of the wearer distributing the breast load;

wherein the first and second ends comprise complementary fastening components for fastening the first and second ends together near the horizontal midpoint of the wearer's back;

wherein loops of elastic material encircle the back strap near each end;

wherein further the loops are moveable horizontally along the back strap;

wherein at least one adjustment component is located on the back strap between the first cup portion and the first end and at least one adjustment component is located between the second cup portion and the second end;

wherein the adjustment components provide a range of up to 8 inches or more of back strap length adjustability.

6. The multi-sized wireless push-up brassiere of claim 5, the back strap further comprising:

a strip of durable elastic material encapsulated by at least one layer of softer material for a comfortable feel on the wearer's skin when worn around the wearer's torso;

wherein the durable elastic material has a snap back strength providing additional support and lift of the wearer's breasts; and wherein the loops on the first and second end of the back strap are constructed of materials as used in constructing the back strap.

7. The multi-sized wireless push-up brassiere as claimed in claim 5, comprising:

the first and second shoulder straps having a first end with side edge;

a second end; and adjustment components on each of said first and second shoulder straps;

wherein the first end edge is permanently attached laterally along an outer lateral edge of the respective first or second cup portions;

wherein the second end includes a hook connection mechanism, the hook further connecting to the loop the end of the back strap, allowing for horizontal movement of the shoulder strap second end along the back strap;

wherein at least one adjustment component is located on each of the first and second shoulder straps between the first and second ends providing for the wearer to be able to adjust a length of the shoulder straps for their specific size to thereby lift said connected first and second cups vertically on said wearer to uplift said wearer's breasts; and wherein the first and second shoulder straps are configured to be arranged in alternative configurations including any one of either vertically across the wearer's shoulders, crisscrossed on a wearer's back, or adjusted to be worn as a halter around the wearer's neck as desired by the wearer.

8. A multi-sized wireless push-up brassiere for providing adjustable breast support and lift for a wearer's breasts, comprising:

a first cup portion;

a second cup portion, the first and second cup portions configured for wearer about a bust line of the brassiere wearer;

a back strap;

said back strap including adjustment components configured to adjust a circumferential size of the brassiere about a torso of said wearer;

a first shoulder strap configured for attachment to the first cup portion; and a second shoulder strap configured for attachment to the second cup portion;

wherein the first and second cup portions each further comprise a lower sling and an upper cup portion;

wherein the lower sling comprises one or more layers of mesh, the one or more layers of mesh comprises a tightly knit mesh material having a web matrix construction of parallel and perpendicular oriented yarns;

wherein further the one or more layers of mesh material comprises a bias cut, the bias cut comprising a bottom edge cut at an oblique angle to the parallel and perpendicular mesh web matrix;

wherein further the bias cut yields extra elasticity properties configured for providing additional support of the wearer's breasts; and wherein the one or more layers of mesh of the lower sling provides optimum elasticity creating an upward vertical push-up force and an inward horizontal push-in force, together providing support for the wearer's breasts.

9. The multi-sized wireless push-up brassiere of claim 1, wherein the lower sling and upper cup portion comprises a combination skin of stretchable, breathable fabric material on the outer portion and stretchable comfortable fabric material on the inside contacting the wearer's skin.

10. The multi-sized wireless push-up brassiere of claim 2, wherein the upper cup portion further comprises an internal single layer of mesh material between the skin of stretchable, breathable material on the outer portion and stretchable comfortable material on the inside contacting the wearer's skin;

wherein the single layer of mesh of the upper cup portion comprises a tightly knit mesh material having a web matrix construction of parallel and perpendicular oriented yarns;

wherein the one or more layers of mesh of the lower sling further comprises an upper edge and the single layer of mesh of the upper cup portion comprises a lower edge;

wherein the lower and upper edges are connected by a seam forming a seamed transition between the lower sling and the upper cup portion;

wherein further the single layer of mesh of the upper cup portion comprises a bias cut, the bias cut comprising a bottom edge cut at an oblique angle to the parallel and perpendicular mesh web matrix; and wherein further the bias cut yields extra elasticity properties providing additional support of the wearer's breasts.

11. The multi-sized wireless push-up brassiere of claim 2, wherein the one or more layers of mesh of the lower sling comprise an upper edge, the upper edge forming an unseamed transition from the lower sling to the upper cup portion.

12. The multi-sized wireless push-up brassiere of claim 8, the first and second cup portions further comprising a bottom edge;

wherein the back strap comprises:

a first end;

a second end;

a center area chest strap; and adjustment components;

wherein the chest strap is attached to and connects to the bottom edge of the first and second cup portions;

wherein the first and second ends are configured to pass around the torso of the wearer thereby distributing the wearer's breast load;

wherein the first and second ends include complementary fastening components for fastening the first and second ends together near the horizontal midpoint of the wearer's back;

wherein loops of elastic material encircle the back strap near each end;

wherein further the loops are moveable horizontally along the back strap;

wherein at least one adjustment component is located on the back strap between the first cup portion and the first end and at least one adjustment component is located between the second cup portion and the second end; and wherein the adjustment components provide a range of up to 8 inches or more of back strap length adjustability.

13. The multi-sized wireless push-up brassiere of claim 8, the back strap further comprising:

a strip of durable elastic material encapsulated by at least one layer of softer material for a comfortable feel on the wearer's skin when worn around the wearer's torso; and wherein the durable elastic material has a snap back strength providing additional support and lift of the wearer's breasts; and wherein the loops on the first and second end of the back strap are constructed of materials used in constructing as the back strap.

14. The multi-sized wireless push-up brassiere as claimed in claim 8, comprising:

each of the first and second shoulder straps having a a first end with a side edge;

a second end; and adjustment components on each of said first and second shoulder straps;

wherein the first end edge is permanently attached laterally along an outer lateral edge of the respective first or second cup portions;

wherein the second end includes a hook connection mechanism, the hook further connecting to the loop therein end of the back strap, allowing for horizontal movement of the should strap second end along the back strap to thereby adjust the shoulder strap placement along he wearer's shoulders;

wherein at least one adjustment component is located on each of the first and second shoulder straps between the first and second ends providing for the wearer to be able to adjust the length of the shoulder straps for their specific size; and wherein the first and second shoulder straps can be arranged vertically across the wearer's shoulders, criss-crossed, or adjusted to be worn as a halter around the wearer's neck as desired by the wearer.

15. A multi-sized wireless push-up brassiere, comprising:

a first cup portion;

a second cup portion, the first and second cup portions configured about a bust line of the brassiere;

a back strap for securing the first and second cup portions around a back of a wearer, the back strap comprising:

woven polyester elastic material providing lift and support without wires; and a pair of elongated strips of relatively softer material sandwiching the woven polyester elastic material on both sides providing softness to the back strap;

loops of elastic material encircled about the back strap near each end, wherein further the loops comprise:

woven polyester elastic material; and a pair of elongated strips of relatively softer material sandwiching the woven polyester elastic material of said loops on both sides thereof;

wherein the first cup portion further comprises a lower sling and an upper cup portion, wherein the lower sling comprises a layer of mesh web matrix material.

16. The multi-sized wireless push-up brassiere of claim 1, the first cup portion further comprising a layer of soft fabric over the layer of mesh material to form the upper cup portion, and together with the mesh material forming the lower sling; and wherein the back strap further comprises a first end and second end;

wherein at least one adjustment component is located on the back strap between the first cup portion and the back strap first end and at least one adjustment component is located between the second cup portion and the back strap second end; and wherein the adjustment components provide a range of up to 8 inches of adjustability for the wearer to achieve a desired brassiere circumference.

17. The multi-sized wireless push-up brassiere of claim 2 wherein the mesh layer comprises an upper edge, the upper edge forming an unseamed transition from the lower sling to the upper cup portion.

18. The multi-sized wireless push-up brassiere of claim 2, wherein the mesh layer comprises an upper edge, the upper edge forming a seamed transition from the lower sling to the upper cup portion, the first cup portion further comprising a layer of soft fabric material on an outside of the first cup portion wherein the seamed transition comprises the layer of soft fabric inside of the layer of mesh material forming the upper cup portion, and together with the mesh material forming the lower sling, wherein further the mesh layer comprises a bias cut, the bias cut comprising a bottom edge cut at an oblique angle to the parallel and perpendicular mesh web matrix, wherein the layer of soft fabric inside of the layer of mesh material comprises a soft stretchable, breathable fabric material.

19. The multi-sized wireless push-up brassiere of claim 1, further comprising:

a first and second shoulder strap each said first and second shoulder strap comprising;

a first end;

a second end; and adjustment components on each of said first and second shoulder straps;

wherein the first end is permanently attached laterally along the outer edge of the respective first or second cup portions whereby said lateral attachment of said strap first end to said lateral outer edge of the respective first and second cup portions provides additional support to an entire each respective cup along said outer lateral cup side and wherein said strap is adjusted upwardly said force pulls said entire cup upwardly and wherein said back strap resiliently pulls said sups inwardly and securely on said wearer's torso;

wherein the second end includes a hook connection mechanism, the hook further connecting to the loop about near the end of the back strap, allowing for horizontal movement of the should strap second end along the back strap to accommodate the wearer's preference or specific size;

wherein at least one adjustment component is located on each of the first and second shoulder straps between the first and second ends;

wherein the first and second shoulder straps are configured to be arranged either vertically across the wearer's shoulders, crisscrossed across the wearer's back, or adjusted to be worn as a halter around the wearer's neck as desired by the wearer.

20. The multi-sized wireless push-up brassiere of claim 1, the first cup portion further comprising:

an outer skin including alternating connected portions of spandex material and soft stretchable spandex material in a zig-zag pattern; and an inner skin contacting a wearer's skin comprising soft breathable cotton material.

21. The multi-sized wireless push-up brassiere of claim 8, wherein the lower sling and upper cup portion comprises a combination skin of stretchable, breathable fabric material on the outer portion and stretchable comfortable fabric material on the inside contacting the wearer's skin.

22. The multi-sized wireless push-up brassiere of claim 11, wherein the one or more layers of mesh of the lower sling comprise an upper edge, the upper edge forming an unseamed transition from the lower sling to the upper cup portion.

23. The multi-sized wireless push-up brassiere of claim 15, the first cup portion further comprising a layer of soft fabric over the layer of mesh material to form the upper cup portion, and together with the mesh material forming the lower sling; and wherein the back strap further comprises a first end and second end;

wherein at least one adjustment component is located on the back strap between the first cup portion and the first end and at least one adjustment component is located between the second cup portion and the second end; and wherein the adjustment components provide a range of up to 8 inches of adjustability for the wearer to achieve a desired brassiere circumferential torso size.

24. The multi-sized wireless push-up brassiere of claim 2 wherein the lower sling internal mesh layer comprises an upper edge, the upper edge forming an unseamed transition from the lower sling to the upper cup portion.

25. The multi-sized wireless push-up brassiere of claim 2, wherein the mesh layer comprises an upper edge, the upper edge forming a seamed transition from the lower sling to the upper cup portion, the first cup portion further comprising a layer of soft fabric material on an outside of the first cup portion wherein the seamed transition comprises the layer of soft fabric inside of the layer of mesh material forming the upper cup portion, and together with the mesh material forming the lower sling, wherein further the mesh layer comprises a bias cut, the bias cut comprising a bottom edge cut at an oblique angle to the parallel and perpendicular mesh web matrix, wherein the layer of soft fabric inside of the layer of mesh material comprises a soft stretchable, breathable fabric material.

26. The multi-sized wireless push-up brassiere of claim 16, further comprising: a first and second shoulder strap, each said first and second shoulder strap comprising;

a first end; a second end; and adjustment components on each of said first and second shoulder straps;

wherein the first end is permanently attached laterally along the lateral outer edge of the respective first or second cup portions;

wherein the second end includes a hook delete "or other" connection mechanism, the hook further connecting to the loop about the end of the back strap, allowing for horizontal movement of the shoulder strap second end along the back strap for adjusting the shoulder strap location horizontally along the wearer's shoulders to accommodate the wearer's preference or specific size;

wherein at least one adjustment component is located on each of the first and second shoulder straps between the first and second ends;

wherein the first and second shoulder straps are configured to be arranged either vertically across the wearer's shoulders, crisscrossed across the wearer's back, or adjusted to be worn as a halter around the wearer's neck as desired by the wearer.

27. The multi-sized wireless push-up brassiere of claim 4 wherein the lower sling internal mesh layer comprises an upper edge, the upper edge forming an unseamed transition from the lower sling upper edge to the upper cup portion lower edge and wherein the unseamed transition includes any one of an overlapped unseamed transition wherein said upper edge of said lower sling overlaps the lower edge of said upper portion or said lower sling upper edge overlaps said upper portion lower edge; a spaced transition wherein said upper and lower edges are spaced apart and wherein the upper and lower edges contact but have free edges that are unseamed.

28. The multi-sized wireless push-up brassiere of claim 1, wherein said first and second cups each include lateral sides with lateral lower corners shaped as right angles; said lateral side edges of each cup are connected directly to an inner side edge of each respective shoulder strap so that each said cup lateral side edge is supported by said shoulder strap and wherein each of said first and second cups have a bottom edge extending from their respective said bottom said right angle that is attached at a center chest strap portion of said back strap.

29. The multi-sized wireless push-up brassiere of claim 1, wherein said lower internal mesh layer is configured from a single layer and is a folded over to form a double layer.

* * * * *